US008613608B2

(12) United States Patent
Ree

(10) Patent No.: US 8,613,608 B2
(45) Date of Patent: Dec. 24, 2013

(54) PROGRESSIVE CAVITY PUMP HAVING AN INNER ROTOR, AN OUTER ROTOR, AND TRANSITION END PIECE

(75) Inventor: Sigurd Ree, Loddefjord (NO)

(73) Assignee: AGR Subsea AS, Straume (NO)

( * ) Notice: Subject to any disclaimer, the term of this patent is extended or adjusted under 35 U.S.C. 154(b) by 507 days.

(21) Appl. No.: 13/059,425

(22) PCT Filed: Aug. 6, 2009

(86) PCT No.: PCT/NO2009/000274
§ 371 (c)(1),
(2), (4) Date: Feb. 17, 2011

(87) PCT Pub. No.: WO2010/021549
PCT Pub. Date: Feb. 25, 2010

(65) Prior Publication Data

US 2011/0150689 A1 Jun. 23, 2011

(30) Foreign Application Priority Data

Aug. 21, 2008 (NO) ..... 20083616

(51) Int. Cl.
*F01C 1/00* (2006.01)
*F04C 2/00* (2006.01)

(52) U.S. Cl.
USPC ..... 418/161; 418/160; 418/48

(58) Field of Classification Search
USPC ..... 418/161, 160, 48–53
See application file for complete search history.

(56) References Cited

U.S. PATENT DOCUMENTS

| | | | | |
|---|---|---|---|---|
| 1,892,217 | A | 12/1932 | Moineau | |
| 2,483,370 | A | 9/1949 | Moineau | |
| 2,553,548 | A | 5/1951 | Canazzi et al. | |
| 3,499,389 | A | 3/1970 | Seeberger et al. | |
| 3,932,072 | A * | 1/1976 | Clark | 418/48 |
| 3,938,915 | A * | 2/1976 | Olofsson | 418/48 |
| 3,999,901 | A | 12/1976 | Tschirky | |
| 4,080,115 | A | 3/1978 | Sims et al. | |

(Continued)

FOREIGN PATENT DOCUMENTS

| | | | |
|---|---|---|---|
| DE | 3119568 | A1 | 2/1982 |
| DE | 3712270 | A1 | 10/1988 |

(Continued)

OTHER PUBLICATIONS

U.S. Appl. No. 13/059,427, filed Jan. 17, 2011, Ree.

(Continued)

*Primary Examiner* — Mary A Davis
(74) *Attorney, Agent, or Firm* — Foley & Lardner LLP

(57) ABSTRACT

An outer rotor of a progressive cavity pump includes at least one inner helical rotor with Z external thread starts and at least one adapted outer rotor with a helical cavity with Z+1 internal thread starts. The at least one outer rotor is assembled from several concentric rotor inserts axially following closely one after another, with helical cavities and Z+1 internal thread starts. Each rotor insert is closely surrounded by and concentrically fixed in a common rigid rotor sleeve. There is detachably connected to the rotor sleeve at least one removable end piece with a principally concentric hollow axially extending through it. The through hollow of the end piece or end pieces forms a gradual transition between a principally circular cross section furthest out and a cross section adapted to the helical cavities of the rotor inserts nearest to them.

29 Claims, 4 Drawing Sheets

(56) References Cited

U.S. PATENT DOCUMENTS

| | | | |
|---|---|---|---|
| 4,482,305 | A | 11/1984 | Nátkai et al. |
| 4,580,955 | A | 4/1986 | Karge |
| 4,585,401 | A | 4/1986 | Baldenko et al. |
| 4,592,427 | A | 6/1986 | Morgan |
| 4,676,725 | A | 6/1987 | Eppink |
| 4,711,006 | A | 12/1987 | Baldenko et al. |
| 5,017,087 | A | 5/1991 | Sneddon |
| 5,097,902 | A | 3/1992 | Clark |
| 5,120,204 | A | 6/1992 | Mathewson et al. |
| 5,275,238 | A | 1/1994 | Cameron |
| 5,358,390 | A | 10/1994 | Jager |
| 5,407,337 | A | 4/1995 | Appleby |
| 5,549,465 | A | 8/1996 | Varadan |
| 5,553,742 | A | 9/1996 | Maruyama et al. |
| 5,588,818 | A | 12/1996 | Houmand et al. |
| 5,722,820 | A | 3/1998 | Wiki et al. |
| 5,807,087 | A | 9/1998 | Brandt et al. |
| 5,820,354 | A | 10/1998 | Wild et al. |
| 5,988,992 | A | 11/1999 | Tetlaff et al. |
| 6,063,001 | A | 5/2000 | Suhling et al. |
| 6,241,494 | B1 | 6/2001 | Pafitis et al. |
| 6,336,796 | B1 | 1/2002 | Cholet et al. |
| 6,439,866 | B1 | 8/2002 | Farkas et al. |
| 6,457,958 | B1 | 10/2002 | Dunn |
| 6,461,128 | B1 | 10/2002 | Wood |
| 7,074,018 | B2 | 7/2006 | Chang |
| 7,300,431 | B2 | 11/2007 | Dubrovsky |
| 7,413,416 | B2 | 8/2008 | Bartu |
| 2001/0005486 | A1 | 6/2001 | Wood |
| 2004/0057846 | A1 | 3/2004 | Denk et al. |
| 2005/0169779 | A1 | 8/2005 | Bratu |
| 2010/0239446 | A1 | 9/2010 | Ree |
| 2010/0329913 | A1 | 12/2010 | Ree |

FOREIGN PATENT DOCUMENTS

| | | | |
|---|---|---|---|
| DE | 86 17 489 | U1 | 11/1990 |
| DE | 197 15 278 | A1 | 12/1998 |
| EP | 0255336 | A2 | 2/1988 |
| EP | 1400693 | A3 | 3/2004 |
| EP | 1 418 336 81 | | 5/2004 |
| EP | 1 559 913 | A1 | 8/2005 |
| NO | 327505 | B1 | 7/2009 |
| WO | WO 99/22141 | A2 | 5/1999 |
| WO | WO 2009/035337 | A1 | 3/2009 |

OTHER PUBLICATIONS

USPTO Notice of Allowance, U.S. Appl. No. 12/678,889, Nov. 8, 2012, 13 pages.

USPTO Office Action, U.S. Appl. No. 12/677,280, Sep. 26, 2012, 14 pages.

USPTO Office Action, U.S. Appl. No. 12/677,280, Feb. 14, 2013, 12 pages.

USPTO Office Action, U.S. Appl. No. 13/059,427, Jan. 15, 2013, 9 pages.

USPTO Notice of Allowance, U.S. Appl. No. 13/059,427, Apr. 1, 2013, 8 pages.

* cited by examiner

PROGRESSIVE CAVITY PUMP HAVING AN INNER ROTOR, AN OUTER ROTOR, AND TRANSITION END PIECE

This invention relates to a progressive cavity pump with inner and outer rotors intended for relatively high rotational speeds and great lifting heights with small vibrations. The invention indicates a possible standardization with a few versions of the main elements of the pump and a number of exchangeable rotor elements with standardized interfaces but with external and/or internal helical cross section(s) adapted for the characteristic viscosity, lifting height and chemical composition of the pumping medium of the most relevant application at any time. From the invention appears a method of limiting the necessary inner diameters of the dynamic seals and bearings of the outer rotor as well.

BACKGROUND

Progressive cavity pumps, also called Mono pumps, PCP pumps, or Moineau pumps, are a type of displacement pumps which are commercially available in a number of designs for different applications. In particular, these pumps are popular for pumping high-viscosity media. Typically, such pumps include a usually metallic helical rotor (in what follows called the inner rotor) with Z number of parallel threads (in what follows called thread starts), Z being any positive integer. The rotor typically runs within a cylinder-shaped stator with a core of an elastic material, a cavity extending axially through it being formed with (Z+1) internal thread starts. The pitch ratio between the stator and rotor should then be (Z+1)/Z, the pitch being defined as the length between adjacent thread crests from the same thread start.

When the geometric design of the threads of the rotor and stator is in accordance with mathematical principles written down by the mathematician Rene Joseph Louis Moineau in, for example, U.S. Pat. No. 1,892,217, the rotor and stator together will form a number of fundamentally discrete hollows or cavities by there being, in any section perpendicular to the centre axis of the rotor screw, at least one point of full or approximately full contact between the inner rotor and the stator. The central axis of the rotor will be forced by the stator to have an eccentric position relative to the central axis of the stator. For the rotor to rotate about its own axis within the stator, also the eccentric position of the axis of the rotor will have to rotate about the centre axis of the stator at the same time but in the opposite direction and at a constant centre distance. Therefore, in pumps of this kind there is normally arranged an intermediate shaft with 2 universal joints between the rotor of the pump and the motor driving the pump.

The pumping effect is achieved by said rotational movements bringing the fundamentally discrete cavities between the inner surfaces of the stator and the outer surfaces of the rotor to move from the inlet side of the pump towards the outlet side of the pump during the conveyance of liquid, gas, granulates etc. Characteristically enough, internationally these pumps have therefore often been termed "PCPs" which stands for, in the English language, "Progressive Cavity Pumps". This is established terminology also in the Norwegian oil industry, for example.

The volumetric efficiency of the pump is determined mainly by the extent to which these fundamentally discrete cavities have been formed in such a way that they actually seal against each other by the relevant rotational speed, pumping medium and differential pressure, or whether there is a certain back-flow because the inner walls of the stator yield elastically or because the stator and rotor are fabricated with a certain clearance between them. To increase the volumetric efficiency, progressive cavity pumps with elastic stators are often constructed with under-dimensioning in the cavity, so that there will be an elastic squeeze fit.

Not very well known and hardly used industrially to any wide extent—yet described already in said U.S. Pat. No. 1,892,217—are designs of progressive cavity pumps in which a part, like the one termed stator above, is brought to rotate about its own axis in the same direction as the internal rotor. In this case the part with (Z+1) internal thread starts may more correctly be termed an outer rotor. At the same time it will then be natural to use the term inner rotor about the part which corresponds to the more usual rotor with an external screw and Z thread starts. By a definite speed ratio between the outer rotor and the inner rotor, both the inner rotor and the outer rotor may be mounted in fixed rotary bearings, provided the rotary bearings for the inner rotor have the correct shaft distance or eccentricity measured relative to the central axis of the bearings of the outer rotor.

A limitation to the gaining of ground of such early-described solutions has probably been that an outer rotor needs to be equipped with dynamic seals and rotary bearings, which is avoided completely when a stator is used. It is also likely that the potential increase in rotational speed and consequent increase in capacity enabled by the fact that the mass centres of both rotors will lie near the rotary axis have been overlooked or underestimated. Besides, an intermediate shaft and universal joints may, in principle, be avoided when the stator is replaced with an outer rotor.

In U.S. Pat. No. 5,407,337 is disclosed a Moineau pump (here called a "helical gear fluid machine"), in which an outer rotor is fixedly supported in a pump casing, an external motor has a fixed axis extending through the external wall of the pump casing parallel with the axis of the outer rotor in a fixed eccentric position relative to it, and the shaft of the motor drives, through a flexible coupling, the inner rotor which has, beyond said coupling, no other support than the walls of the helical cavity of the outer rotor, the material assumedly being an elastomer. In this case the rotation of the outer rotor is driven exclusively by movements and forces at the contact surfaces of the inner cavity against the inner rotor. A drawback of this solution is that if there is considerable clearance at or elastic deflection of the contact surface, the inner rotor or the outer rotor will be moved more or less away from its ideal relative position. Further, by increasing load, the driving contact surface between the inner and outer rotors will be moved constantly closer to the motor and thereby force the inner rotor more and more out of parallelism relative to the axis of the outer rotor, so that over the length of the outer rotor, the inner rotor will contact the outer rotor on diametrically opposite sides with consequent friction loss, wear on rotors and motor coupling and also possible signs of wedging. Vibrations, erratic running and reduced efficiency may also be expected.

In U.S. Pat. No. 5,017,087 as well as WO99/22141 inventor John Leisman Sneddon has shown designs of Moineau pumps, in which the outer rotor of the pump is enclosed by and fixedly connected to the rotor of an electromotor whose stator windings are fixedly connected to the pump casing. In these designs the outer and inner rotors of the pump are both fixedly supported at both ends radially in the same pump casing, so that the outer and inner rotors of the pump function together as a mechanical gear, driving the inner rotor at the correct speed relative to the outer rotor which, in turn, is driven by said electromotor. In this case as well, signs of wedging between the inner and outer rotors may arise, in particular if solid, hard particles seek to wedge between the inner and outer rotors where these have their driving contact surfaces. Besides, a disadvantage of an inner rotor fixedly supported at both ends is that if the pumping medium is of a kind which must be separated from contact with the bearings, independent dynamic seals will be needed at both ends for both the inner rotor and the outer rotor, as these do not have a common rotary axis.

In U.S. Pat. No. 4,482,305 is shown a pump, flow gauge or similar according to the PCP principle with inner and outer rotors. Here is used a wheel gear outside the pump rotors which ensures a stably correct relative rotational speed between the inner and outer rotors, independently of internal contact surfaces between them. This ensures smoother running, in particular by great pressure differences and/or spacious clearances—which may be necessary to achieve a gradual pressure increase when compressible media are pumped. However, it is assumed here as well that there are dynamic seals and radial bearings at both ends of the inner rotor. The dynamic seal for the outer rotor is also complicated by the diameter of the sealing surface having to be large enough to allow an internal passage for both the pumping medium and the bearing shaft on the extension of the active helical part of the inner rotor.

In the Norwegian patent application No. 20074591 is indicated a method of stabilizing the flow rate and outlet pressure in a progressive cavity pump with internal and external rotors intended for pumping compressible media. According to this document, signs of sudden cyclical back-flows of pumping medium in consequence of compression during the adjustment to the outlet pressure can be effectively limited by letting the defined pump cavity which is, at any time, the closest to the outlet side be allowed to have a substantially larger continuous leakage flow than the other pump cavities. To be as effective as possible, this leakage flow must be planned and be built into the construction of the outer and/or inner rotor(s) in each individual case. The document does not indicate a way of limiting the costs of this adaptation through, for example, letting it affect as few and as inexpensive parts as possible.

In most known designs of progressive cavity pumps with inner and outer rotors is required—unless the pumping medium is of a kind which may be allowed to penetrate into the bearings of the outer rotor or even function as an active component in hydrodynamic bearings—a large diameter on the dynamic seals of the outer rotor with consequent relatively large leakage, frictional moment and hydrostatic axial forces on the bearings of the outer rotor. A reason for the big seal diameter is that the seal normally surrounds the entire helical cavity with Z+1 thread starts and that this cross section cannot be reduced towards the seal if the inner rotor is to be installable from the same side as the seal and if the outer rotor is to be made in one piece. With this typical construction there will also be an unfavourable flow pattern as pumping medium is let in and out, because the medium meets the plane end surface of the outer rotor as an obstruction vertically to the direction of flow.

The invention has for its object to remedy or reduce at least one of the drawbacks of the prior art.

The object is achieved through features which are specified in the description below and in the claims that follow.

SUMMARY

Thus, the invention provides an outer rotor of such construction that the diameter of dynamic seals and bearings may be reduced, flow transitions smoothed, application adaptations simplified and wear parts replaced more easily and more inexpensively. The invention also enables a relatively simple, quick and inexpensive testing of alternative adaptations between the inner and outer rotor, so that, among other things, pressure build-up from step to step by the relevant gas volume percentage and viscosity can be optimized for a specific application.

This is achieved by an outer rotor being assembled from a rigid rotor sleeve adapted to the rotary bearings of the outer rotor at both ends, by the sleeve closely surrounding a number of exchangeable, concentric rotor inserts closely adjoining each other in an axial direction, by the sleeve having a detachable end piece at least at one end, by this end piece being adapted for maintaining the axial position of alternative sets of rotor inserts, by the sleeve and/or its end piece(s) having, at a respective end, a through hollow which forms a transition between round cross sections nearest to the inlet side or the outlet side and principally wing-shaped cross sections with Z+1 wings corresponding to and abutting the helical cavity having Z+1 thread starts extending through every rotor insert.

An outer rotor in a progressive cavity pump comprising at least one inner helical rotor with Z external thread starts and at least one adapted outer rotor with a helical cavity with Z+1 internal thread starts may be characterized by at least an outer rotor being assembled from several concentric rotor inserts following closely one after another axially and having helical cavities and Z+1 internal thread starts, each rotor insert being closely surrounded by and concentrically fixed in a common rigid rotor sleeve, and there being detachably connected to the rotor sleeve at least one removable end piece with a principally concentric cavity extending axially through it, and by the through hollow of the end piece or end pieces forming a gradual transition between a principally circular cross section furthest out and a cross section adapted to the helical cavities of the rotor inserts nearest to them.

The outer rotor may have at least one detachable end piece which rotates in a surrounding bearing for the outer rotor and the through hollow surrounded in the axial position by the bearing has a principally circular cross section with its longest diagonal substantially smaller than the longest diagonal in the helical cross sections of the rotor inserts.

Nearest to the inlet and/or outlet of the outer rotor, the outer rotor may have room installed or arranged for a mechanical or other dynamic seal—or a seat for this, with a diameter for the sealing surface which is smaller than the longest diagonal for the helical cavities of adjacent rotor inserts.

The outer rotor may be formed in such a way that the rotor sleeve has a through hollow with a principally constant cross section adapted for the tight installation of rotor inserts having principally the same external cross section, retained between two detachable end pieces.

The outer rotor may be formed in such a way that the outer rotor has a detachable end piece only on one side of the rotor sleeve, that in the rotor sleeve, from the side of the detachable end piece, extends an axial cavity of a principally constant cross section and depth adapted for the tight installation of a number of axially measured-out rotor inserts, that the constant cross section suddenly changes into a smaller cross section adapted to the helical cavity of the rotor inserts, and that, from here, there is arranged a through flow channel which merges gradually into a principally circular shape at the outlet.

The outer rotor may be formed in such a way that at least one rotor insert has a length divisible by P/Z, P being the thread pitch of the inner rotor and Z being the number of thread starts on the inner rotor.

The outer rotor may be formed in such a way that several of the inserts have a certain rotation relative to each other, freely adjusted to minor deviations from the ideal ratio between the thread pitches of the inner and outer rotors.

The outer rotor may be formed in such a way that the rotor sleeve is fixed against rotation relative to at least one end piece and at least one rotor insert with a helical cavity adapted for driving contact with the inner rotor.

The outer rotor may be formed in such a way that all the rotor inserts are fixed against rotation relative to each other and against rotation relative to the rotor sleeve.

The outer rotor may be formed in such a way that for fixing rotor inserts against rotation relative to each other there are used dowels in corresponding bores.

The outer rotor may be formed in such a way that in mutual-contact surfaces between the rotor inserts are arranged elastic seals in adapted grooves in at least one of the contact surfaces, that these grooves relatively closely surround the helical cavity cross section, and that the depth of the grooves is adapted in such a way that the elastic seal will have the right pre-tensioning when the gap between the plane end surfaces of adjacent rotor inserts is completely neutralized.

The outer rotor may be formed in such a way that all the rotor inserts have a cylindrical outer surface with principally the same diameter and easy-running fit relative to the rotor sleeve, that near the middle of the cylinder surface is arranged a cylindrical groove with an exact internal diameter adapted for guide bushes which are arranged, when mounted together with the rotor insert, to run tightly in the rotor sleeve but allow close contact between adjacent inserts with a compensation for possible minor angular deviations at the end surfaces relative to the vertical on the rotary axis.

The outer rotor may be formed in such a way that the rotor insert located nearest to the outlet side has a helical cavity length fundamentally equaling P/Z, P being the thread pitch of the inner rotor, and that on the upstream end surface of said insert is made a recess in the form of a local substantial increase of the cavity cross section, that this increased cavity cross section provides substantially increased clearance locally between the inner and outer rotors, that this increased clearance varies with the relative angular positions of the inner and outer rotors, and that, in each individual case, the varying clearance is sought to be adjusted in such a way that the transversal leakage flow from the last cavity, which is open or shortened towards the outlet side, up to the last, fundamentally discrete full-length cavity will cause a gradual compression of the fluid in the last full-length cavity, so that the pressure difference towards the outlet will decrease approximately linearly down to an acceptable minimum before the last full-length cavity suddenly opens wide as it reaches the outlet of the screw.

The outer rotor may be formed in such a way that said recess has been milled out at a constant depth, so that the adaptation has been done only by calculating the shape of the cross section, and that there is a seal between the transversal contact surfaces of the inserts outside said recess.

The outer rotor may be formed in such a way that the rotor sleeve and at least one of the rotor inserts are made of a metallic, thermally conductive material and are in metallic connection with each other.

The outer rotor may be formed in such a way that at least one of the inserts, preferably nearest to the inlet side, is made of a viscoelastic material, for example rubber, and that the cavity of this insert is made with a nominal squeeze fit relative to the helical part of the inner rotor.

The outer rotor as described above may be formed in such a way that the rotor sleeve has a sufficient diameter for accommodating rotor inserts with considerable variation in the helical cavity cross section, including variation in the number of thread starts Z, longest diagonal of the cross section, and eccentricity.

The outer rotor may be formed in such a way that transitions in the cavity cross section extending through the end pieces are neutralized by special inserts flush mounted in the actual end pieces.

The outer rotor may be formed in such a way that the rotor sleeve coincides with a rotor of a motor driving the progressive cavity pump.

A range of alternative rotor inserts adapted to the same rotor sleeve may be stocked at the producer's with a view to adaptation for different customer requirements and applications.

The invention will be particularly advantageous in embodiments in which the rotor sleeve of the pump coincides with the rotor of a motor driving the pump, cf. WO99/22141 mentioned earlier.

BRIEF DESCRIPTION OF THE DRAWINGS

In what follows is described an example of a preferred embodiment which is visualized in the accompanying drawings, in which.

DETAILED DESCRIPTION

Figure 1:
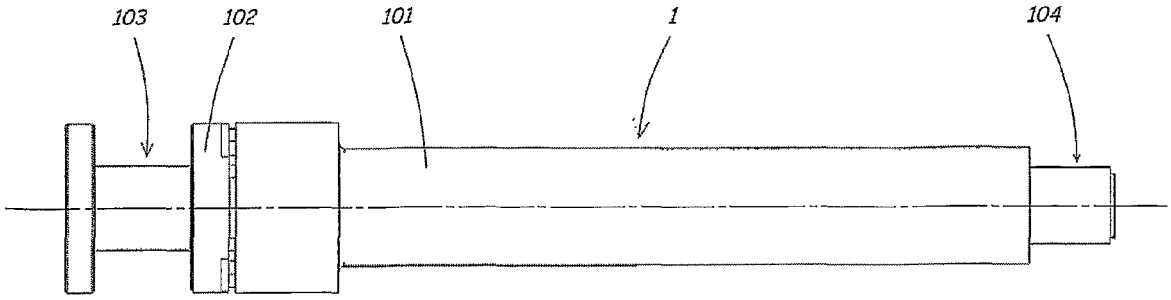
FIG. 1 shows an embodiment of an outer rotor in accordance with the invention, in which the rotor sleeve has a fixed bottom at one end and a removable end piece at the opposite end.

In the embodiment of an outer rotor in accordance with FIG. 1, the reference numeral 1 indicates this version of a completely assembled outer rotor, whereas 101 indicates the rotor sleeve without the detachable end piece, and 102 indicates the detachable end piece of the rotor. In this embodiment the outer rotor is intended for mounting in an axial bearing 104 and in a split hydrodynamic radial and axial bearing 103 known per se.

Figure 2:
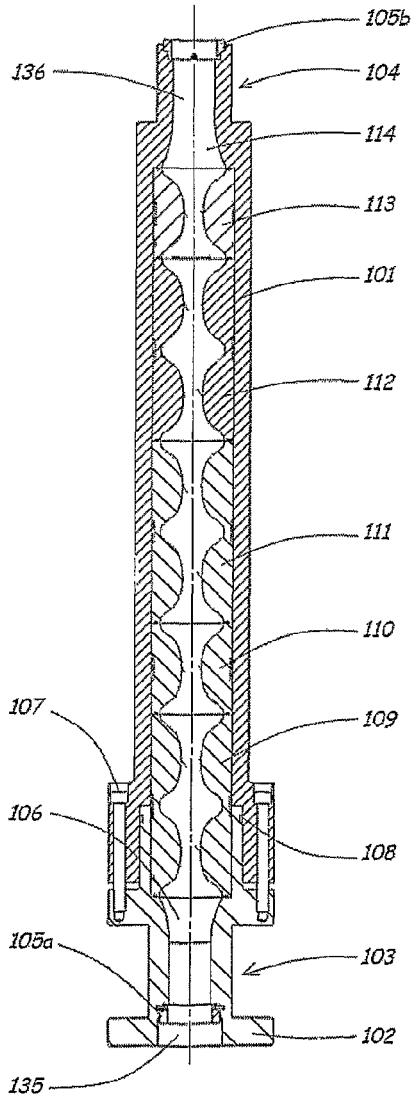
FIG. 2 shows a longitudinal central cross section of the outer rotor according to FIG. 1.

In the section in FIG. 2, 105*a* and 105*b* indicate co-running seats for mechanical seals on the inlet side and outlet side, respectively. The through hollow of the end piece 102 has a transition portion 106, in which the hollow merges smoothly and gradually from a cylindrical cross-sectional shape into a wing-shaped cross section with Z+1 wings corresponding to the cross section of a helical cavity in the rotor inserts 109-113. Correspondingly, the hollow portion 114 forms a smooth and gradual transition back into a cylindrical cross section 136 adapted for the seal seat 105*b*.

The seal seat 105*b* has a substantially smaller diameter than the longest cross section of the helical cavity portions. The connection between the rotor sleeve 101 and end piece 102 is secured by means of the bolts 107 and sealed with a static seal 108.

Figure 3:
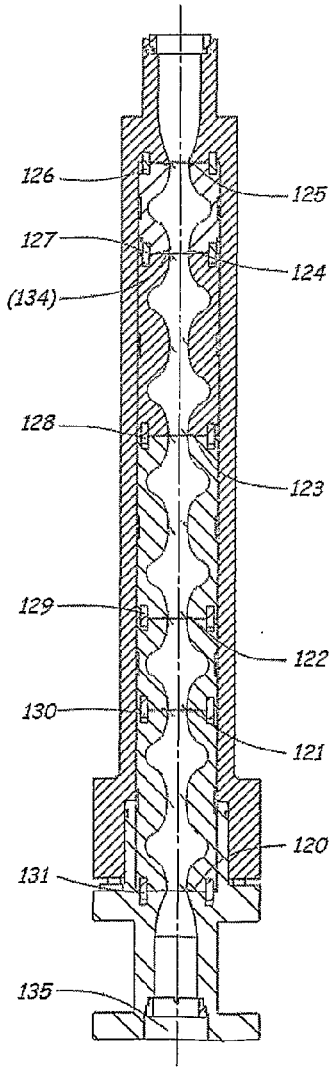
FIG. 3 shows another longitudinal central cross section of the outer rotor according to FIG. 1, here oriented vertically to the plane of section of FIG. 2.

In FIG. 3 is shown how the rotor inserts in this exemplary embodiment are fixed against rotation relative to each other and relative to the rotor sleeve 101 and end piece 102 by means of latch pins 126-131 arranged in pairs. Further, the figure shows how static seals 120-125, which may be, for example, common or metallic O-rings depending on the application, prevent the pumping medium from flowing back between the rotor inserts and rotor sleeve.

Figure 4:
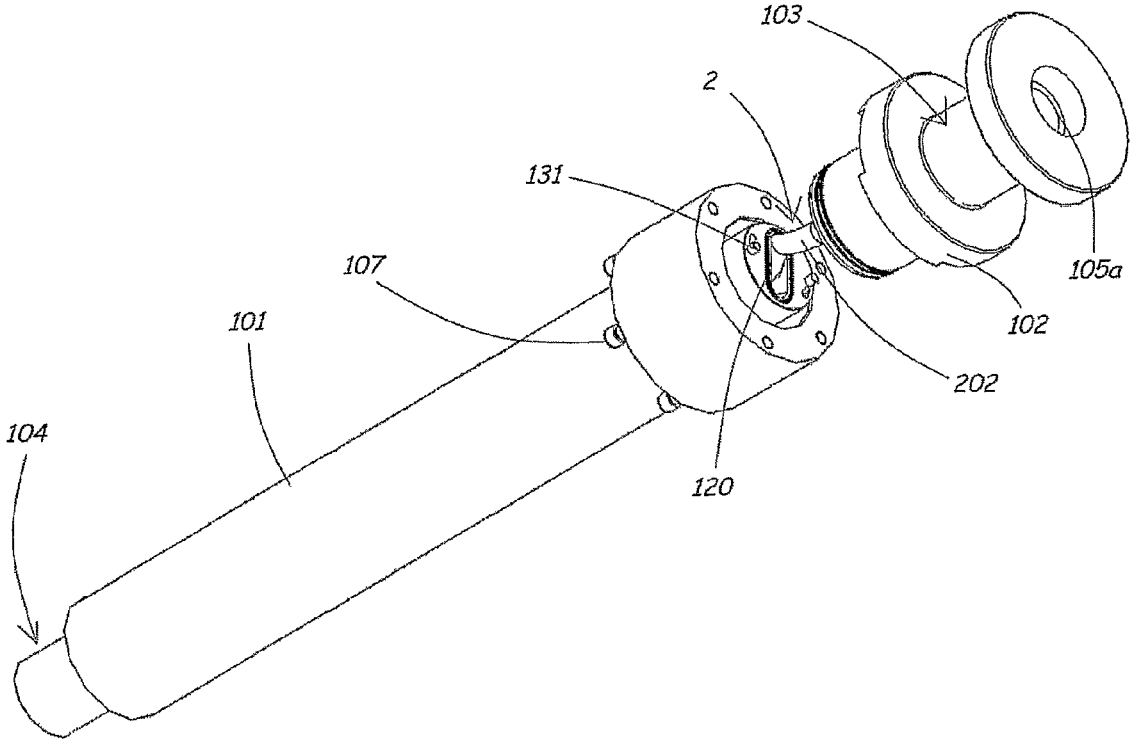
FIG. 4 shows in perspective the same embodiment as FIG. 1 during assembly, in which all the rotor elements and inner rotor have been installed in the rotor sleeve and it only remains to slip the end piece of the sleeve over the extended shaft of the inner rotor and then bolt the end piece of the sleeve.
Figure 5:
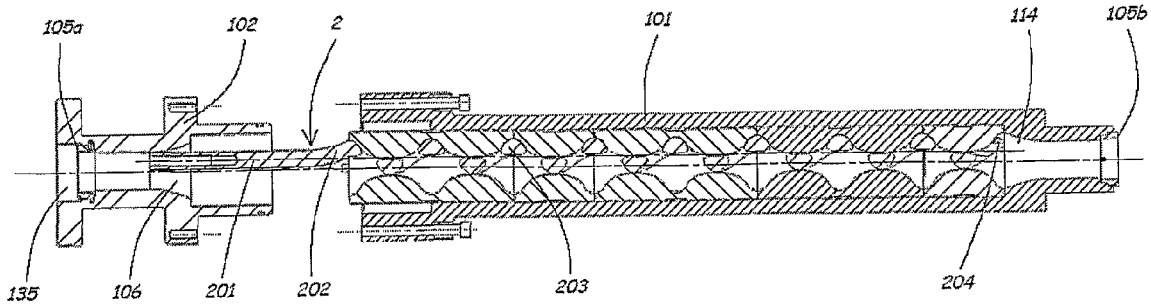
FIG. 5 shows a longitudinal section of the situational picture of FIG. 4, from which it is seen how the inner rotor is positioned in the outer rotor and it only remains to push the end piece of the rotor sleeve into place and bolt it.

When the inner and outer rotors have been assembled, it is not possible to slip a helical part 202, see FIG. 5, of an inner rotor 2, see FIGS. 4-5, through the inner cross-sectional transitions 106 or 114. Before installing the inner rotor 2 it is therefore necessary to remove the end piece 102 as shown in FIG. 4. This figure also shows more clearly the seals 108 and 120 and the latch pins 131. The seal 120 is installed in recesses near and principally of the same shape as the wing-shaped screw cross section. This is seen more clearly still in FIG. 8 and is done partly to limit the risk of crevice corrosion in the case of metallic inserts and partly to limit axial forces on the bolts 107 and rotor sleeve 101 by great work pressures.

In FIG. 5 the inner rotor is installed in its final position in the outer rotor, whereas the end piece 102 is in the process of being fitted. The reference numeral 202 indicates an in this case plane bend on the inner rotor 2 between an extension shaft 201 and a helical portion 203. The bend 202 has been adapted to the cross-sectional transition 106 in such a way that during relative eccentric rotation with the speed ratio Z/Z+1 between respectively the outer 1 and inner 2 rotors, there will never be direct contact between the surfaces of the bend 202 and hollow portion 106 after completed assembly with the end piece bolted. Correspondingly, since in this case, the inner rotor has been stepped down 204 and terminated before the hollow transition 114, there will never be a conflict during rotation between the inner rotor 2 and the outer rotor 1 near the outlet side.

Figure 6:
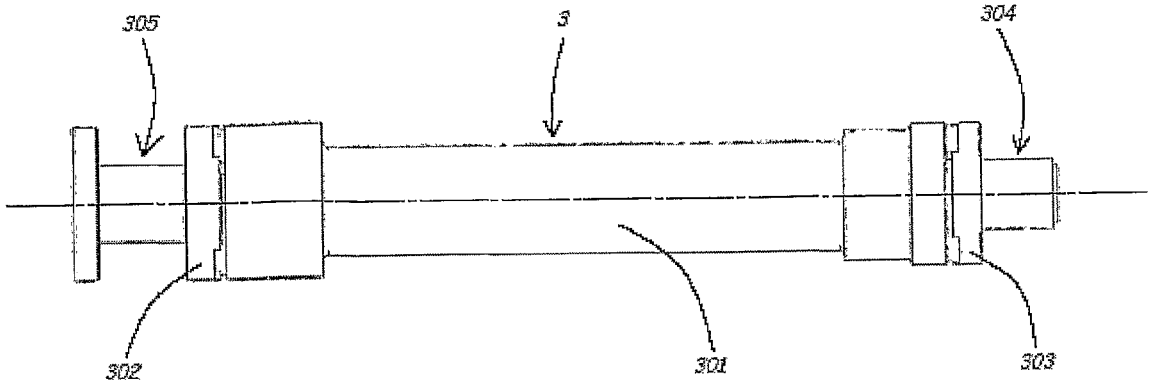
FIG. 6 shows the exterior of another embodiment of the outer rotor in accordance with the invention, in which the rotor sleeve lacks a fixed bottom but has detachable end pieces on both the inlet side and the outlet side.

FIG. 6 shows another embodiment 3 of the assembled outer rotor in accordance with the invention. In this embodiment, the rotor sleeve 301 has detachable end pieces on both sides, respectively 302 on the outlet side and 303 on the inlet side. Complicating in this case will be the requirement for linearity between bearing surfaces 304 and 305. On the other hand, in this embodiment, the rotor sleeve 301 itself may be kept unchanged even by a change to rotor inserts 307-311 of essentially different screw cross sections, for example a new number of thread starts Z+1. However, the end pieces 302 and 303 will have to be replaced, so that the hollow transitions 306 and 312 will match the new inserts. Please note that new clearance margins between the inner and outer rotors—which will be highly relevant by optimal adaptations for new viscosities, differential pressures or gas content in the pumping medium—will not call for a replacement of the end pieces. It will also be possible to keep the same version of both the rotor sleeve and the end pieces by a number of different combinations of pitch and number of cavities in the pump.

Figure 7:
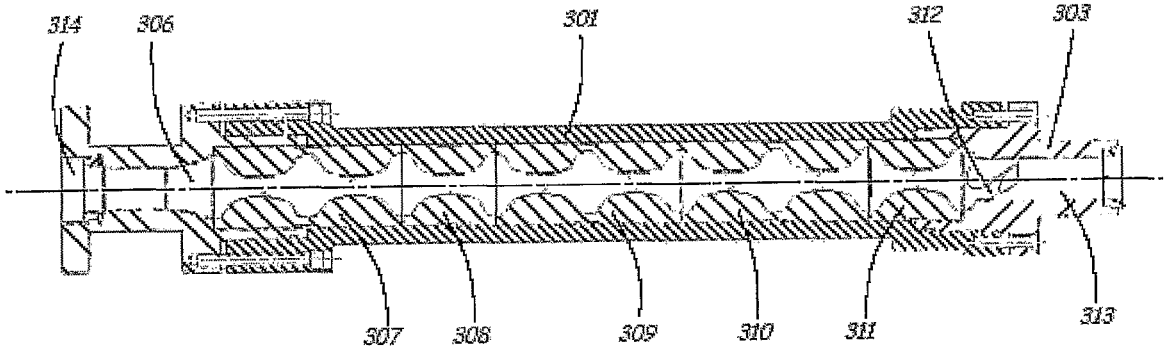
FIG. 7 shows a longitudinal central section of the embodiment according to FIG. 6.

In FIG. 7 is shown that the hollow of the end piece 303 has a substantially different transition portion 312 from that shown in the figure references 306, 106 and 114. Here it is assumed that the inner rotor has been extended a distance past the rotor insert 311 into adapted grooves in the portion 312 of a flow hollow 313. This embodiment has a somewhat larger cylindrical flow area than the transition portions shown earlier, which gives reason to choose a flow direction such that the larger flow areas 312, 313 come on the inlet side where they reduce the risk of cavitation.

Figure 8:
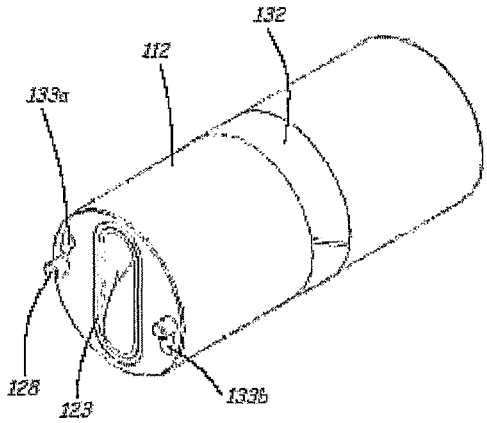
FIG. 8 shows a typical rotor element with corresponding details for sealing, positioning, mounting and dismounting.

In FIG. 8 is shown a typical rotor insert 112 complete with associated details. Here are shown dowels 128 for positioning and fixation against rotation about the central axis while the O-ring 123 or similar is in an adapted groove for sealing against the adjacent rotor insert. The reference numeral 132 denotes a guide band in an adapted groove for accurate centring in the sleeve, closest possible contact between end surfaces of adjacent inserts, reduced resistance during installation in the rotor sleeve and reduced requirements for fitting tolerance between the internal diameter of the sleeve and the outer diameter of the rotor insert. However, please note that even though all the exemplary embodiments of the rotor inserts shown have a cylindrical external surface, this is not a limitation of the scope of protection. For example, it will be within the scope of the invention to give both rotor inserts and the internal surface of the sleeve an oval or polygonal cross section, and thus may be render the dowels 126-131 superfluous.

In FIG. 8 are also suggested key-shaped, recessed grooves 233*a*, 133*b* with assumedly widened inner cross sections, which are arranged in diametrically opposite positions outside the seal 123. These are meant to be adapted for a tool for assembling and particularly disassembling the inserts, and the tool possibly consisting of bolt heads adapted to the key holes and mounted on a cross-bar so that the bolt heads may be hooked into the grooves forming holding-up elements in both directions axially, for both assembling and disassembling. At the same time, twisting of the tool cross-bar will adjust the position of the dowels in such a way that these will meet the corresponding holes. Please note that each insert has holes for dowels on both end surfaces, but that the dowels are pre-mounted only on the top side of the inserts relative to the direction of installation.

Figure 9:
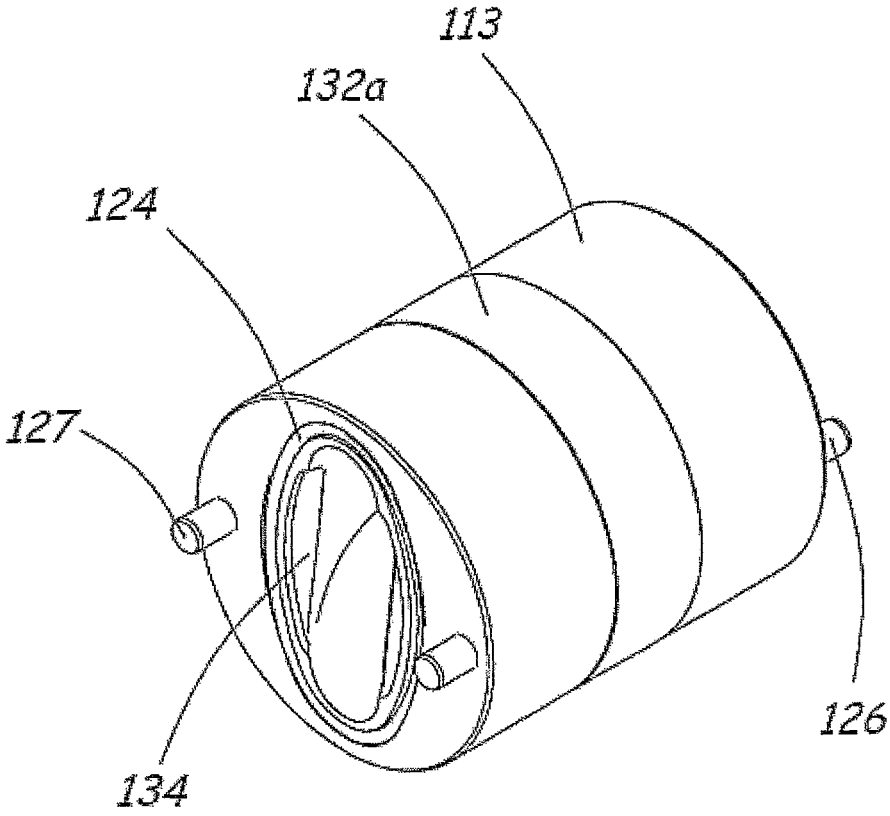
FIG. 9 shows a special design of a rotor element meant for mounting nearest to the outlet side, with a length corresponding to half a turn of the inner helical cavity and with a recess in the contact surface towards the nearest upstream adjacent rotor element. The rotor element of FIG. 9 will be a special design in accordance with the Norwegian patent application 20074591 "Progressing cavity pump adapted to pumping of compressible fluids".

In FIG. 9 is shown a special variant of a rotor insert 113 intended for mounting nearest to the outlet side. This insert has a length corresponding to $1/(Z-1)=½$ turn of the internal helical cavity which has, in this case, Z+1=2 wings or thread starts.

Like in the rotor insert of FIG. 8 there is a guide ring 132*a* here as well. Dowels 126, 127 are here quite possibly pre-mounted on both end surfaces of the outer insert. The particular thing about this rotor insert is, first and foremost, the oval recesses 134 within an oval sealing groove with an oval seal 124, for example in the form of a common or metallic O-ring. This oval recess 134 is a simple way of constructing an outer rotor which provides increased back-flow to the last cavity—the one nearest to the outlet—in order thus to stabilize the outlet pressure in particular when compressible fluids are pumped. Please note that this subtlety in general is protected by and described in the previously filed Norwegian patent application 20074591.

In a further embodiment of the invention, the outer rotor of a progressive cavity pump is characterized in that several of the inserts have a certain rotation relative to each other, freely adjusted to minor deviations from the ideal ratio between the thread pitches of the inner and outer rotors. In this embodiment, for several of the rotor inserts, it has been omitted to mount precise fixing devices against minor relative rotational movements about the central axis, so that each individual rotor insert finds, as required, its rotational position adjusted to the inner rotor in spite of minor deviations in the pitch of the cavity screw, whether owing to manufacturing deviations or operating conditions with associated geometrical deviations induced chemically, thermally or by pressure.

Thus, according to some embodiments of the present invention, an outer rotor of a progressive cavity pump comprises at least one inner helical rotor with Z external thread starts; and at least one adapted outer rotor with a helical cavity with Z+1 internal thread starts. The at least an outer rotor (1, 3) is assembled from several concentric rotor inserts (109-113, 307-311) following closely one after another axially, with helical cavities and Z+1 internal thread starts. Each rotor insert of the several concentric rotor inserts is tightly surrounded by and concentrically fixed in a common rigid rotor sleeve (101, 301). The rotor sleeve is detachably connected to at least one removable end piece (102, 302, 303) with a principally concentric hollow portion extending axially through the at least one end piece. The through hollow portion of the end piece (102) or end pieces (302, 303) forms a gradual transition (106, 306, 312) between a principally circular cross section (135, 313, 314) furthest out from the rotor inserts and a cross section adapted to the helical cavity in the rotor insert (109, 307, 311) nearest to the at least one end piece.

The invention claimed is:

1. A progressive cavity pump comprising:

at least one inner rotor with Z external thread starts; and at least one outer rotor with a helical cavity with Z+1 internal thread starts, wherein the at least one outer rotor is assembled from a plurality of rotor inserts axially following closely one after another, the rotor inserts having helical cavities and Z+1 internal thread starts, wherein each rotor insert of the plurality of rotor inserts is tightly surrounded by and concentrically fixed in a common rigid rotor sleeve, wherein the rotor sleeve is detachably connected to at least one removable end piece with a principally concentric through hollow portion extending axially through the at least one removable end piece, and wherein the through hollow portion forms a gradual transition between a principally circular cross section furthest out from the plurality of rotor inserts and a cross section in the rotor insert nearest to the at least one end piece.

2. The progressive cavity pump in accordance with claim 1, wherein the at least one removable end piece is rotatable in a surrounding bearing.

3. The progressive cavity pump in accordance with claim 2, wherein the through hollow portion that is surrounded in an axial position by the surrounding bearing has a principally circular cross section with its longest diagonal substantially smaller than a longest diagonal in a helical cross section of the plurality of rotor inserts.

4. The progressive cavity pump in accordance with claim 1, wherein one of a seal or a seat for the seal is arranged nearest to one of an inlet of the outer rotor, an outlet of the outer rotor, or combination thereof.

5. The progressive cavity pump in accordance with claim 4, wherein the one of the seal or the seat for the seal is the seat for the seal, and wherein the seat has a sealing surface with a diameter that is smaller than a longest diagonal of a helical cavity in an adjacent rotor insert.

6. The progressive cavity pump in accordance with claim 1, wherein the rotor sleeve has a hollow portion of a principally constant cross section extending therethrough, wherein the hollow portion of the rotor sleeve is adapted for close fitting of the rotor inserts, the rotor inserts having principally a same external cross section as the principally constant cross section of the hollow portion of the rotor sleeve, and wherein the at least one removable end piece comprises two removable end pieces that retain the rotor sleeve.

7. The progressive cavity pump in accordance with claim 1, wherein the at least one removable end piece is a detachable end piece only on one side of the rotor sleeve, wherein the rotor sleeve comprises an axial hollow portion of a principally constant cross section and depth extending from the one side of the rotor sleeve, wherein the axial hollow portion of the rotor sleeve is adapted for tight installation of the plurality of the rotor inserts, wherein the axial hollow portion of the rotor sleeve has two distinct sections comprising of a principally constant cross section adapted to accommodate the helical cavities of the rotor inserts which suddenly changes into a smaller cross section, and wherein the smaller cross section of the axial hollow portion of the rotor sleeve is arranged as a through flow channel which gradually transitions into a principally circular shape at an outlet of the rotor sleeve.

8. The progressive cavity pump in accordance with claim 1, wherein at least one rotor insert of the plurality of rotor inserts has a length divisible by P/Z, P being a thread pitch of the inner rotor and Z being a number of external thread starts on the inner rotor.

9. The progressive cavity pump in accordance with claim 1, wherein several of the plurality of rotor inserts have a certain rotation relative to each other, that is freely adjusted to minor deviations from an ideal ratio between a thread pitch of the inner rotor and a thread pitch of the outer rotor.

10. The progressive cavity pump in accordance with claim 9, wherein the rotor sleeve is fixed against rotation relative to the at least one removable end piece and at least one rotor insert of the plurality of rotor inserts, and wherein the helical cavity of the at least one rotor insert is adapted for driving contact with the inner rotor.

11. The progressive cavity pump in accordance with claim 1, wherein all of the plurality of rotor inserts are fixed against rotation relative to each other and against rotation relative to the rotor sleeve.

12. The progressive cavity pump in accordance with claim 11, wherein dowels inserted into corresponding bores fix the plurality of rotor inserts such that all of the plurality of rotor inserts are fixed against rotation relative to each other.

13. The progressive cavity pump in accordance with claim 1, wherein the plurality of rotor inserts comprises at least two adjacent rotor inserts having contact surfaces, wherein an elastic seal is arranged between the contact surfaces of the adjacent rotor inserts, and wherein a groove is disposed in at least one of the contact surfaces of the adjacent rotor inserts for the elastic seal to be situate therein.

14. The progressive cavity pump in accordance with claim 13, wherein the groove relatively closely surrounds helical cavity cross sections of the adjacent rotor inserts, and wherein a depth of the groove is adapted such that the elastic seal will have a correct pre-tensioning when a gap between the contact surfaces of the adjacent rotor inserts is minimized.

15. The progressive cavity pump in accordance with claim 1, wherein all of the plurality of the rotor inserts have a cylindrical outer surface with principally a same diameter and easy-running fit relative to the rotor sleeve, wherein, for each one of the plurality of rotor inserts, a cylindrical groove is arranged near a middle of the cylindrical outer surface with an internal diameter adapted to guide a bush, wherein the bush of each one of the plurality of rotor inserts is arranged to run in a tight-fitting manner in the rotor sleeve when assembled with the plurality of rotor inserts, and to allow close abutment between adjacent rotor inserts with compensation for any minor angular deviations at end surfaces of the plurality of rotor inserts that run vertical to a rotary axis.

16. The progressive cavity pump in accordance with claim 1, wherein one of the plurality of rotor inserts is placed closest to an outlet side of the rotor sleeve, the one of the plurality of rotor inserts has a helical cavity length fundamentally equal to P/Z, P being a thread pitch of the inner rotor, wherein a recess is formed on an upstream end surface of the one of the plurality of rotor inserts and takes a form of a local substantial increase in cavity cross section, wherein the increase in the cavity cross section locally gives a substantially increased clearance between the inner rotor and the outer rotor, and wherein the substantially increased clearance varies with relative angular position of the inner rotor and the outer rotor.

17. The progressive cavity pump in accordance with claim 16, wherein the recess has been milled out at a constant depth, and wherein a seal is between transversal contact surfaces of the one of the plurality of rotor inserts and an adjacent rotor insert outside said recess.

18. The progressive cavity pump in accordance with claim 16, wherein the varying clearance is adjustable such that transversal leakage flow from a last cavity open or shortened towards the outlet side to a last fundamentally discrete full-length cavity causes gradual compression of a fluid in the last fundamentally discrete full-length cavity such that a pressure difference towards an outlet decreases approximately linearly down to an acceptable minimum before the last fundamentally discrete full-length cavity suddenly opens wide as the fluid reaches the outlet.

19. The progressive cavity pump in accordance with claim 1, wherein the rotor sleeve and at least one of the plurality of rotor inserts are made of a metallic thermally conductive material and are in metallic connection with each other.

20. The progressive cavity pump in accordance with claim 1, wherein at least one of the plurality of rotor inserts is made of a viscoelastic material, and wherein the helical cavity of the at least one of the plurality of rotor inserts has been made with a nominal squeeze fit relative to a helical part of the inner rotor.

21. The progressive cavity pump in accordance with claim 20, wherein the at least one of the plurality of rotor inserts is nearest to an inlet side of the rotor sleeve and is made of rubber.

22. The progressive cavity pump in accordance with claim 1, wherein the rotor sleeve has a sufficient diameter for accommodating the plurality of rotor inserts with considerable variation in helical cavity cross sections, and wherein said variation comprises one of variation in the number of the internal thread starts Z, a longest diagonal of the helical cavity cross section, and eccentricity.

23. The progressive cavity pump in accordance with claim 22, further comprising special inserts fitted in the at least one removable end piece and configured to minimize transitions in a through hollow cross section of the at least one removable end piece.

24. The progressive cavity pump in accordance with claim 1, wherein the rotor sleeve coincides with a rotor of a motor configured to drive the progressive cavity pump.

25. A pump comprising:

at least one inner rotor with Z external thread starts; and at least one outer rotor with a helical cavity with Z+1 internal thread starts, wherein the at least one outer rotor comprises a plurality of rotor inserts following closely one after another in an axial direction, wherein each rotor insert of the plurality of rotor inserts is tightly surrounded by and concentrically fixed in a common rigid rotor sleeve, wherein the rotor sleeve is detachably connected to at least one removable end piece with a through hollow portion extending axially through the at least one removable end piece, and wherein the through hollow portion forms a gradual transition between a principally circular cross section furthest out from the plurality of rotor inserts and a cross section in the rotor insert nearest to the at least one removable end piece.

26. The pump in accordance with claim 25, wherein the rotor sleeve has a hollow portion extending therethrough, wherein the hollow portion of the rotor sleeve is adapted for close fitting of the plurality of rotor inserts, and wherein the at least one removable end piece comprises two removable end pieces that retain the rotor sleeve.

27. The pump in accordance with claim 25, wherein the at least one removable end piece is a detachable end piece only on one side of the rotor sleeve, wherein the rotor sleeve comprises an axial hollow portion having a cross section adapted to accommodate helical cavities of the plurality of rotor inserts, and wherein the cross section of the axial hollow portion of the rotor sleeve is arranged as a through flow channel which gradually transitions into a principally circular shape at an outlet of the rotor sleeve.

28. The pump in accordance with claim 25, wherein the rotor sleeve is fixed against rotation relative to the at least one removable end piece and at least one rotor insert of the plurality of rotor inserts, and wherein a helical cavity of the at least one rotor insert is adapted for driving contact with the inner rotor.

29. The pump in accordance with claim 25, wherein the plurality of rotor inserts comprises at least two adjacent rotor inserts having contact surfaces, and wherein an elastic seal is arranged between the contact surfaces of the adjacent rotor inserts.

* * * * *